US011607881B2

(12) United States Patent
Kasai et al.

(10) Patent No.: US 11,607,881 B2
(45) Date of Patent: Mar. 21, 2023

(54) ELEMENT SUBSTRATE, LIQUID DISCHARGE HEAD, AND PRINTING APPARATUS

(71) Applicant: CANON KABUSHIKI KAISHA, Tokyo (JP)

(72) Inventors: Ryo Kasai, Tokyo (JP); Toshio Negishi, Kanagawa (JP); Nobuyuki Hirayama, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 8 days.

(21) Appl. No.: 17/123,827

(22) Filed: Dec. 16, 2020

(65) Prior Publication Data

US 2021/0187941 A1 Jun. 24, 2021

(30) Foreign Application Priority Data

Dec. 18, 2019 (JP) ..... JP2019-228613

(51) Int. Cl.

*B41J 29/38* (2006.01)
*B41J 2/045* (2006.01)
*B41J 2/14* (2006.01)

(52) U.S. Cl.

CPC ..... *B41J 2/0458* (2013.01); *B41J 2/0451* (2013.01); *B41J 2/04596* (2013.01); *B41J 2/14153* (2013.01); *B41J 2/04563* (2013.01)

(58) Field of Classification Search

CPC .. B41J 2/0458; B41J 2/04553; B41J 2/04555; B41J 2/04565

See application file for complete search history.

(56) References Cited

U.S. PATENT DOCUMENTS 5,255,011 A * 10/1993 Minowa ..... B41J 2/365 347/196
8,075,101 B2 * 12/2011 Aoki ..... B41J 2/0458 347/14
9,033,442 B2 5/2015 Kanno et al.
10,308,021 B2 6/2019 Nomura et al.
2012/0306953 A1 12/2012 Kanno et al.
2018/0079205 A1 * 3/2018 Yamashita ..... B41J 2/04568
2019/0381790 A1 12/2019 Kasai et al.

FOREIGN PATENT DOCUMENTS

JP 4-211961 A 8/1992
JP 5801612 B2 10/2015

* cited by examiner

*Primary Examiner* — Lam S Nguyen
(74) *Attorney, Agent, or Firm* — Venable LLP

(57) ABSTRACT

In a head substrate according to an embodiment of the present invention comprises a plurality of nozzles for discharging liquid; a plurality of electrothermal transducers corresponding to the plurality of nozzles; and a plurality of drivers corresponding to the plurality of electrothermal transducers, the substrate has the following configuration. Specifically, it comprises a detection circuit that detects, in a case where one of the plurality of electrothermal transducers is selected, a temperature of the selected transducer to which a first signal is applied to in order to discharge a liquid from a nozzle corresponding to the selected electrothermal transducer, and then a second signal is applied to heat the selected electrothermal transducer.

16 Claims, 9 Drawing Sheets

ELEMENT SUBSTRATE, LIQUID DISCHARGE HEAD, AND PRINTING APPARATUS

BACKGROUND OF THE INVENTION

Field of the Invention

The present invention relates to an element substrate, a liquid discharge head, and a printing apparatus, and particularly to, for example, a printing apparatus using, as a printhead, a liquid discharge head incorporating an element substrate to perform printing in accordance with an inkjet method.

Description of the Related Art

For example, printing apparatuses which print information of desired characters and images on a sheet-type print medium such as a sheet or a film are widely used as an information output device in a word processor, a personal computer, and a facsimile. Such printing apparatuses include inkjet printing apparatuses which print characters and images by discharging ink droplets onto the print medium.

Among inkjet printing apparatuses (hereinafter, referred to as "printing apparatuses"), there are those of a type that, while conveying the print medium, discharges the ink from a fixed full-line printhead whose print width is the same as the width of a print medium, and there are those of a type that discharges ink droplets while reciprocally scanning with a carriage on which a printhead is mounted. In any case, apparatuses in which a head substrate in which a plurality of print elements are integrated is incorporated in such a printhead, and that use thermal energy as energy for discharging ink droplets are well known. In a head substrate which discharges ink using such thermal energy, an electrothermal transducer (a heater) is arranged at a part which communicates with a discharge orifice for discharging ink droplets as a print element, and an electric current is supplied to the electrothermal transducer to generate heat, and ink droplets are discharged by film boiling of the ink.

It is easy to arrange a large number of the discharging orifices and the electrothermal transducers (heaters) at a high density in such a printhead, and it is possible to obtain a high definition print image thereby. Meanwhile, there are cases where a discharge failure occurs in some or all of the nozzles due to clogging of a nozzle due to a foreign substance, air bubbles mixing into the ink supply channel, changes in wettability of the nozzle surface, or the like. It is an important problem to be solved for such a printhead to identify a nozzle where the discharge failure occurred, and perform complementary printing by discharging ink from a neighboring nozzle or feed back to a recovery operation on the printhead.

To solve this problem, Japanese Patent No. 5801612 proposes a method of arranging a temperature detection element formed in a thin film resistor via the insulation film in each of the print elements in a head substrate, and detecting temperature information of each of the nozzles to inspect a nozzle of a discharge failure based on temperature change conditions. More specifically, in a heater temperature decrease process, it is detected whether or not there is rapid change in which the temperature decreases (hereinafter, feature point), and if that feature point appears, it is judged to be a normal discharge. Note that, it is considered that this feature point appears when the trailing edge of the discharged ink droplet contacts the heater and the temperature of the print element is cooled down.

For an inkjet printhead (hereinafter, referred to as "printhead"), a high-sensitivity temperature detection element is needed because significant noise occurs due to very long wiring from the printing apparatus main body, which has the power supply, to the print element since a large electric current flows to the head substrate. Also, recent printheads, in conjunction with having longer print widths, have enlarged head substrates, and the result of this is that manufacturing costs are increasing, and so there is a need for cost reduction.

FIGS. 11A and 11B are views illustrating a cross section of a heater unit integrated on a head substrate which was proposed in Japanese Patent No. 5801612 and the result of a simulation of a temperature change of the heater. FIG. 11A illustrates the temperature change of the heater that can be detected by the sensor when the heater is heated, and FIG. 11B illustrates a cross section of the heater which is integrated on the head substrate. In FIG. 11A, the ordinate indicates the temperature (° C.), the abscissa indicates time (μs), the solid line indicates the change in time of the temperature at the center of the heater, and the dashed line indicates change in the temperature of the center of a sensor for detecting the temperature of the heater. Also, the upper part of FIG. 11A illustrates the pulse signal applied to drive the heater.

As illustrated in FIG. 11B, a sensor (temperature detection element) 902 consisting of a thin film resistor for detecting the heater temperature is arranged directly below a heater 901. Also, the heater 901 and the sensor 902 are electrically insulated from each other by an insulation film 903. In the upper part of the heater 901, an anti-cavitation film 904 is formed.

In such a structure, as illustrated in FIG. 11A, a bubble 906 is created when a main pulse 908 is applied to the heater 901 to heat it up, and an ink droplet is discharged by the force of the bubbling, but in the bubble dissipation process, heat dissipates from the heater 901, and the temperature of the heater gradually decreases. When the bubble dissipates completely, heat dissipates from the surface of the anti-cavitation film 904 to the ink all at once since the bubble 906 is replaced by ink 907, and a feature point 905 (a steep temperature change) appears in the change in temperature of the heater.

Since the timing when the bubble dissipates is much later in the case of ink discharge failure compared to the case of a normal discharge of ink, there is a difference in the timing when the feature point 905 appears and the temperature change amount. By comparing this difference, discharging and discharge failure are detected. In Japanese Patent No. 5801612, by applying a post pulse 909 immediately prior to the feature point 905 appearance, and making the temperature change amount of the heater 901 at the feature point 905 more conspicuous, the amplitude of the discharge detection signal is made to become larger.

In order to detect the change in temperature at the feature point 905 at a higher sensitivity, ideally the temperature is detected at a location close to the bubble 906. Accordingly, in Japanese Patent No. 5801612, the sensor 902 is arranged directly below the heater 901. As shown in FIG. 11A, it can be seen that around the feature point 905, the change in temperature is dull and the sensitivity is low at the center of the sensor compared to in the center of the heater. Also, since an additional process in the semiconductor manufacturing process for producing the head substrate is needed in order to form the sensor 902 directly below the heater 901, this is a factor in cost increases.

Meanwhile, because the heater itself is being used as the sensor for performing temperature detection in the configuration proposed by Japanese Patent Laid-Open No. 114-211961, temperature detection at a location with a good thermal response is enabled. However, the temperature output portion in such a circuit is a voltage dividing resistor output, and the result of that is that the output signal voltage becomes higher, and attempting to achieve such a high-voltage output is a factor in an increase in the cost of the circuit. The signal output ends up becoming even weaker with voltage division. Accordingly, when the resistor voltage division ratio is increased in order to increase the signal output and decrease the output voltage, more electric current flows, and so the heater heats up, and it becomes a cause of heater disconnection or heater deterioration.

SUMMARY OF THE INVENTION

Accordingly, the present invention is conceived as a response to the above-described disadvantages of the conventional art.

For example, an element substrate, a liquid discharge head, and a printing apparatus according to this invention are capable of high-precisely detecting a heater temperature with inexpensive arrangement.

According to one aspect of the present invention, there is provided an element substrate comprising: a plurality of nozzles configured to discharge a liquid; a plurality of electrothermal transducers corresponding to the plurality of nozzles; a plurality of drivers corresponding to the plurality of electrothermal transducers; and a detection circuit configured to detect, in a case where one of the plurality of electrothermal transducers is selected based on an inputted signal, a temperature of the selected electrothermal transducer to which a first signal is applied in order to discharge a liquid from a nozzle corresponding to the selected electrothermal transducer, and then a second signal is applied to heat the selected electrothermal transducer.

According to another aspect of the present invention, there is provided a liquid discharge head using an element substrate having the above arrangement, comprising: a judgment circuit configured to judge whether liquid is discharged from the nozzle corresponding to the selected electrothermal transducer based on a feature point that appears in a change over time of the temperature of the electrothermal transducer detected by the detection circuit; and a first constant electric current source configured to supply a constant electric current to drive the detection circuit, wherein a first power supply voltage applied to the plurality of drivers is higher than a second power supply voltage applied to drive the first constant electric current source.

According to still another aspect of the present invention, there is provided a printing apparatus for performing printing on a print medium comprising: a printhead configured to use a liquid discharge head having the above arrangement; a first generation unit configured to generate the first signal and output the first signal to the printhead to drive the plurality of drivers in order to discharge ink from nozzles corresponding to the plurality of drivers; a second generation unit configured to generate a signal for selecting an electrothermal transducer for the detection circuit to detect the temperature, and to output the signal to the printhead; and a control unit configured to control printing by the printhead based on a result of the judgement by the judgment circuit.

The invention is particularly advantageous since it is possible to high-precisely detect the temperature of a heater with a lower cost configuration without using a dedicated sensor.

Further features of the present invention will become apparent from the following description of exemplary embodiments (with reference to the attached drawings).

DESCRIPTION OF THE EMBODIMENTS

Figure 1:
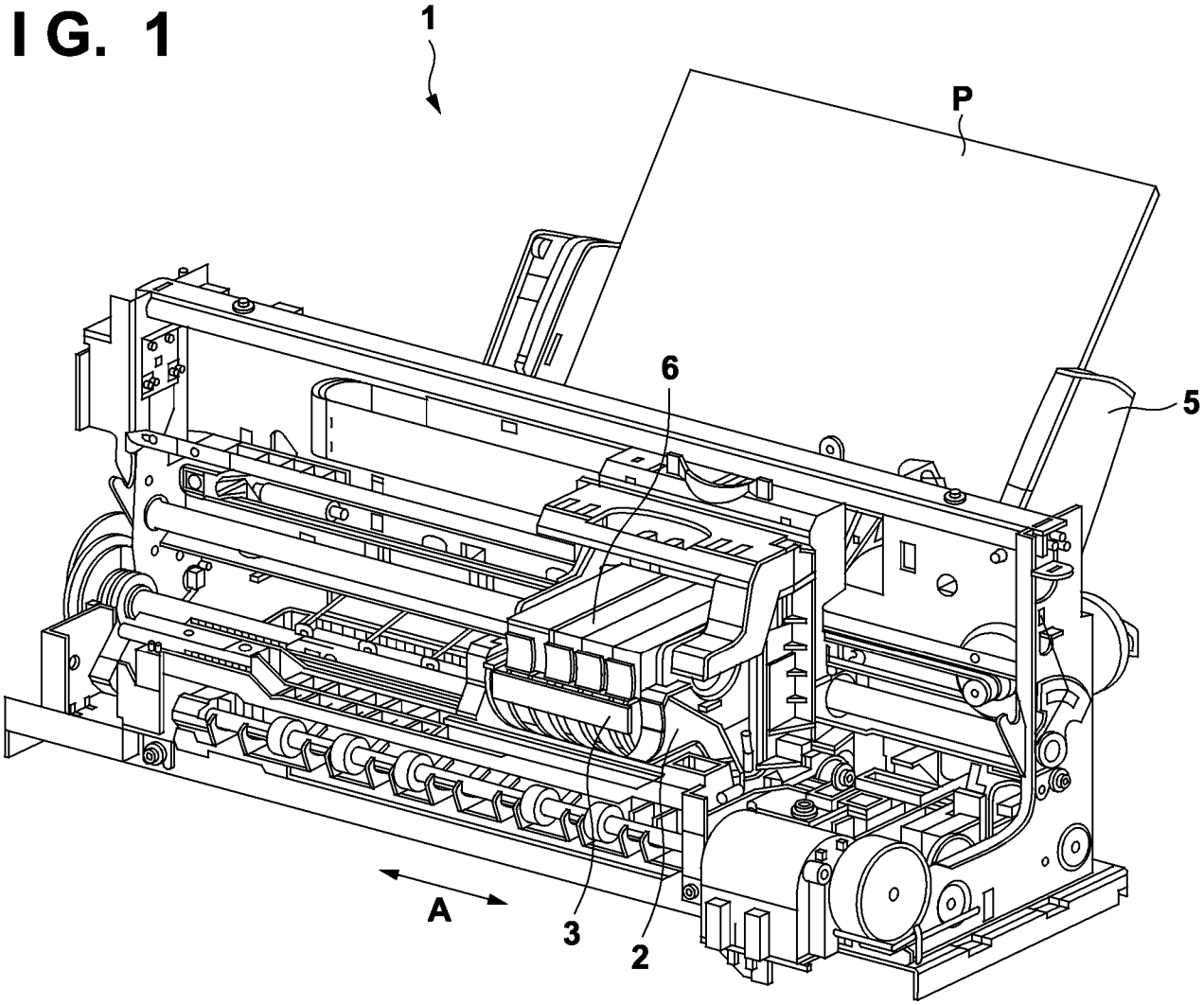
FIG. 1 is a perspective view showing the schematic arrangement of a printing apparatus including a printhead according to an exemplary embodiment of the present invention.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" (to be also referred to as "print element" hereinafter) generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Description of Outline of Printing Apparatus (FIGS. 1 and 2)>

FIG. 1 is an external perspective view showing the outline of the arrangement of a printing apparatus that performs printing using an inkjet printhead (to be referred to as a printhead hereinafter) according to an exemplary embodiment of the present invention.

As shown in FIG. 1, in an inkjet printing apparatus (to be referred to as a printing apparatus hereinafter) 1, an inkjet printhead (to be referred to as a printhead hereinafter) 3 configured to discharge ink in accordance with an inkjet method to perform printing is mounted on a carriage 2. The carriage 2 is reciprocally moved in the direction of an arrow A to perform printing. A print medium P such as print paper is fed via a paper feed mechanism 5, conveyed to a printing position, and ink is discharged from the printhead 3 to the print medium P at the printing position, thereby performing printing.

In addition to the printhead 3, an ink tank 6 storing ink to be supplied to the printhead 3 is attached to the carriage 2 of the printing apparatus 1. The ink tank 6 is detachable from the carriage 2.

A printing apparatus 1 shown in FIG. 1 can perform color printing, and for this purpose, four ink cartridges storing magenta (M), cyan (C), yellow (Y), and black (K) inks, respectively, are mounted on the carriage 2. The four ink cartridges are detachable independently.

The printhead 3 according to this embodiment employs an inkjet method of discharging ink using thermal energy. Hence, the printhead 3 includes an electrothermal transducer (heater). The electrothermal transducer is provided in correspondence with each orifice. A pulse voltage is applied to a corresponding electrothermal transducer in accordance with a print signal, thereby discharging ink from a corresponding orifice. Note that the printing apparatus is not limited to the above-described serial type printing apparatus, and the embodiment can also be applied to a so-called full line type printing apparatus in which a printhead (line head) with orifices arrayed in the widthwise direction of a print medium is arranged in the conveyance direction of the print medium.

Figure 2:
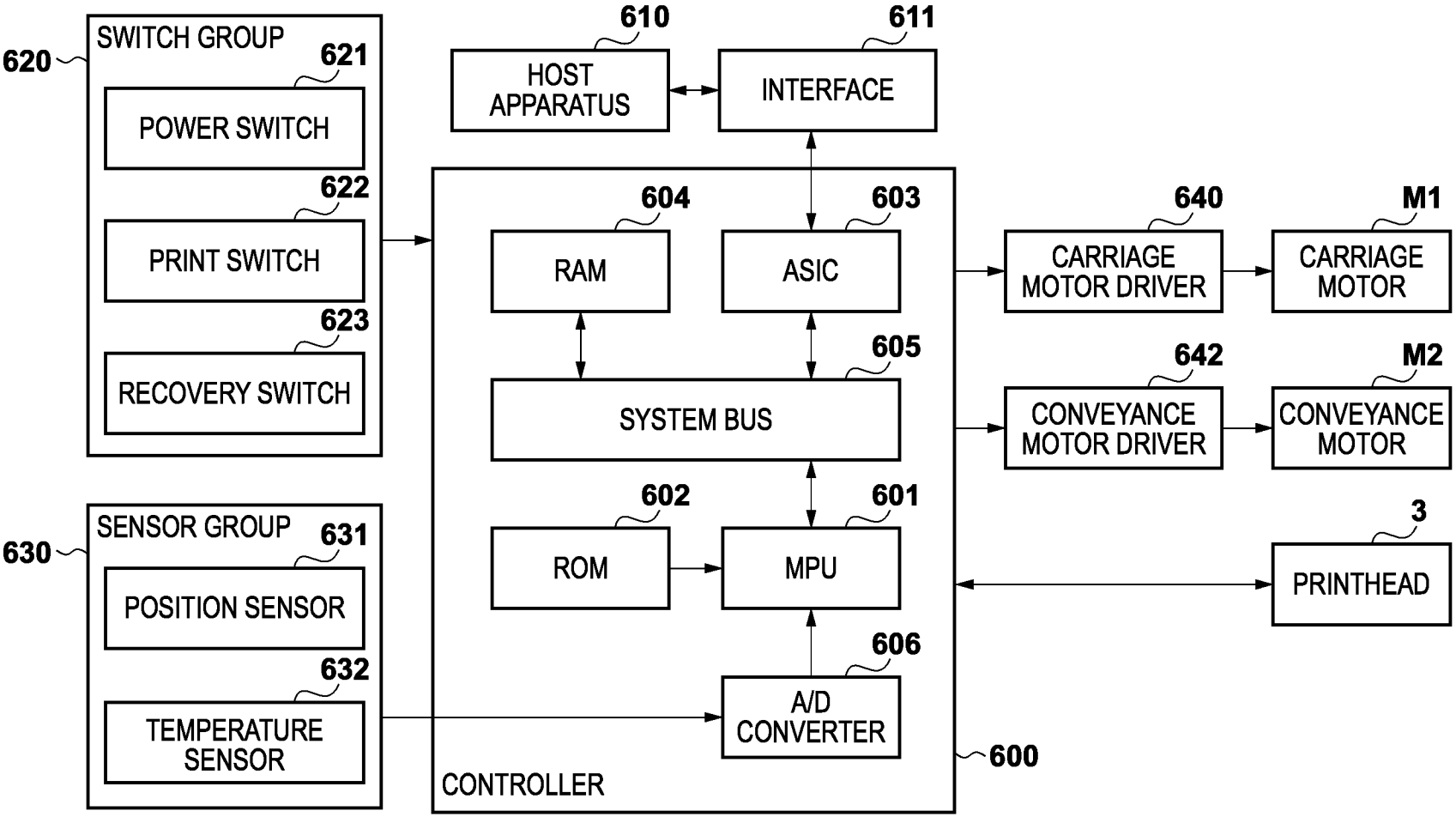
FIG. 2 is a block diagram showing the control configuration of the printing apparatus shown in FIG. 1.

FIG. 2 is a block diagram showing the control configuration of the printing apparatus shown in FIG. 1.

As shown in FIG. 2, a controller 600 is formed by an MPU 601, a ROM 602, an application specific integrated circuit (ASIC) 603, a RAM 604, a system bus 605, an A/D converter 606, and the like. Here, the ROM 602 stores programs corresponding to control sequences, necessary tables, and other fixed data. The ASIC 603 generates control signals for control of a carriage motor M1, control of a conveyance motor M2, and control of the printhead 3. The RAM 604 is used as an image data expansion area, a working area for program execution, and the like. The system bus 605 connects the MPU 601, the ASIC 603, and the RAM 604 to each other to exchange data. The A/D converter 606 receives an analog signal from a sensor group to be described below, performs A/D conversion, and supplies a digital signal to the MPU 601.

Additionally, referring to FIG. 2, reference numeral 610 denotes a host apparatus, corresponding to a printing apparatus shown in FIG. 1 or an MFP, which serves as an image data supply source. Image data, commands, statuses, and the like are transmitted/received by packet communication between the host apparatus 610 and the printing apparatus 1 via an interface (I/F) 611. Note that as the interface 611, a USB interface may be provided independently of a network interface to receive bit data or raster data serially transferred from the host apparatus.

Reference numeral 620 denotes a switch group which is formed by a power switch 621, a print switch 622, a recovery switch 623, and the like.

Reference numeral 630 denotes a sensor group configured to detect an apparatus state and formed by a position sensor 631, a temperature sensor 632, and the like.

Reference numeral 640 denotes a carriage motor driver that drives the carriage motor M1 configured to reciprocally scan the carriage 2 in the direction of the arrow A; and 642, a conveyance motor driver that drives the conveyance motor M2 configured to convey the print medium P.

The ASIC 603 transfers data used to drive a heating element (a heater for ink discharge) to the printhead while directly accessing the storage area of the RAM 604 at the time of print scan by the printhead 3. In addition, the printing apparatus includes a display unit formed by an LCD or an LED as a user interface.

In the printhead 3, a head substrate, in which a plurality of nozzles, a plurality of electrothermal transducers (heaters), a logic circuit for driving the plurality of electrothermal transducers, and the like are integrated, is incorporated. To this head substrate, a plurality of electrothermal transducers are comprised in correspondence with the plurality of nozzles for discharging ink droplets, and by heating these electrothermal transducers, film boiling is generated to occur in the ink, and thereby the ink is caused to bubble, and by the force of the bubbling, the ink is discharged. Also, in the head substrate, there is a configuration in which a desired electrothermal transducer (heater) is selected from among the plurality of electrothermal transducers (heaters), and the temperature thereof is detected. Accordingly, the head substrate can detect whether ink has been discharged successfully or discharge failure occurred, depending on the change in the detected temperature of the selected electrothermal transducer.

Figure 3:
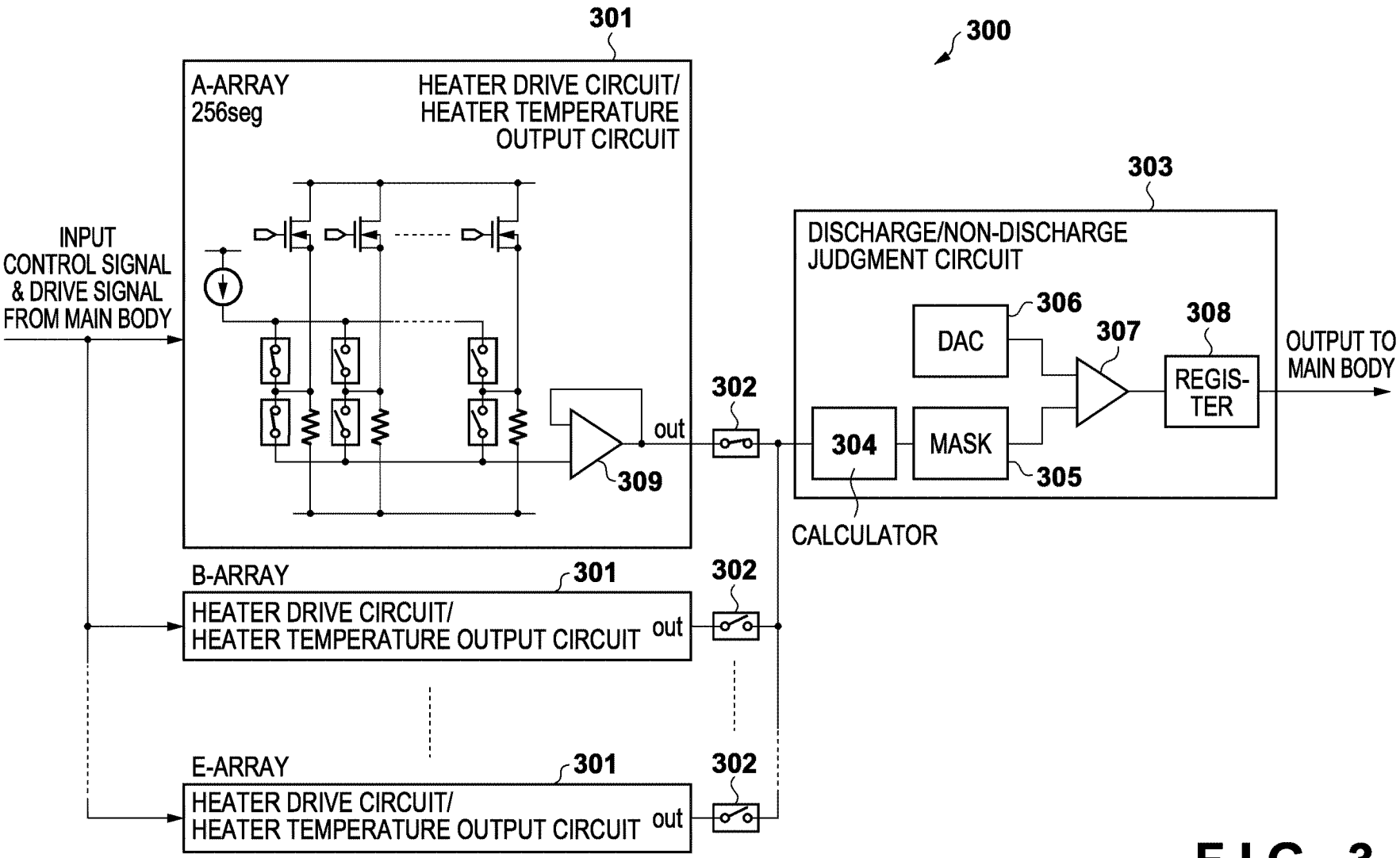
FIG. 3 is a block diagram illustrating an overview configuration of a head substrate in which a discharge detection circuit is incorporated.

FIG. 3 is a block diagram illustrating an overview configuration of a head substrate in which a discharge detection circuit is incorporated.

The head substrate 300 has five arrays (array A, array B, array C, array D, and array E) of heater arrays in which 256 electrothermal transducers (heaters) are arranged in a row. As illustrated in FIG. 3, a heater driving/heater temperature output circuit 301 is arranged in each heater array, and, in each of the 256 segments (seg) of each heater array, a heater temperature output circuit 309 and a monitor switch 302 are arranged.

Furthermore, one discharge/non-discharge judgment circuit 303 is arranged for array A to array E, and the monitor switch 302 turns ON only one heater array to output the heater temperature voltage of a desired segment (seg) of the desired array, and detects discharge/non-discharge of the corresponding nozzle. Also, it is possible to supply ink of different colors (for example, Y, M, C, K dye, and K pigment) to the heaters of each array, to achieve full-color printing.

The resistance values of the respective electrothermal transducers (heater: heat generating resistor) have temperature dependencies, and by inputting a driving pulse signal, the temperature rapidly rises, but the temperature decreases after a peak temperature is reached, and in this temperature decrease process, the resistance value changes. Accordingly, since the voltage of the driven electrothermal transducer changes dependent upon the temperature, it is possible to estimate (detect) the temperature of the electrothermal transducer by monitoring the voltage value. Therefore, the monitored voltage is said to be the heater temperature voltage.

A signal indicating the heater temperature voltage is inputted to a computing device 304, and high-frequency noise is removed from that signal, and a first order derivative with respect to time is taken, and the change over time of the feature point is converted into a wave height value. The signal waveform after the derivative is masked before and after the feature point by a mask circuit 305, and by a comparator 307, the threshold voltage outputted from a DAC 306 and the derivative waveform peak are compared, and it is judged whether it is a discharge or a non-discharge. After that, digitized judgement data is transferred to the main body portion of the printing apparatus from a register 308. Meanwhile, a driving signal for performing printing by driving the electrothermal transducers (heaters) of a head substrate, a control signal for a heater temperature detection, and the like are inputted to each heater driving/heater temperature output circuit 301 from the main body portion of the printing apparatus.

Hereinafter, several embodiments of configuration of temperature detection for an electrothermal transducer in the head substrate integrated on the printhead of the printing apparatus with the above-described arrangement will be described.

First Embodiment

Figure 4:
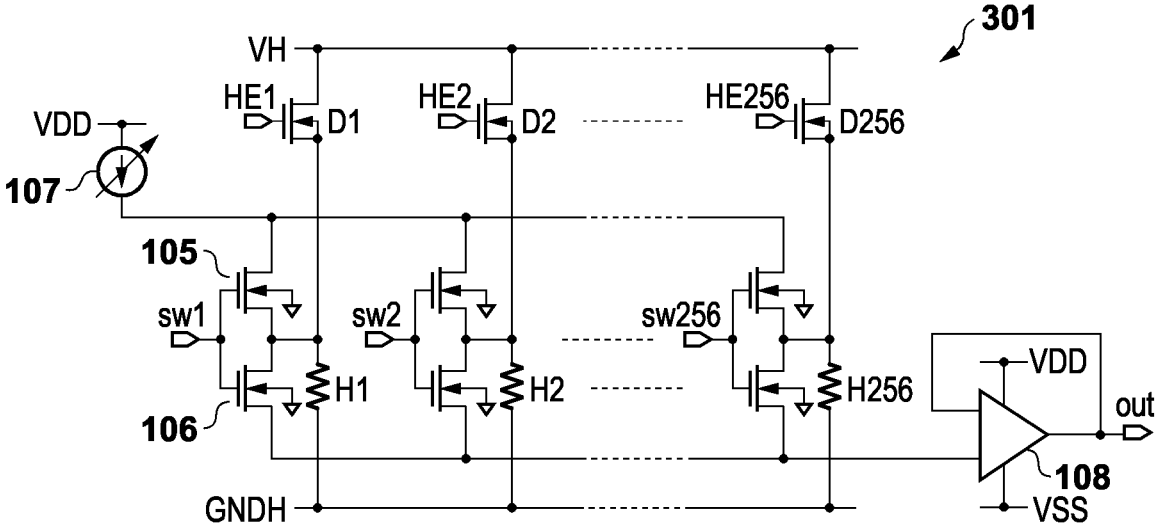
FIG. 4 is an equivalent circuit diagram illustrating a detailed configuration of a heater driving/heater temperature output circuit according to the first embodiment.

FIG. 4 is an equivalent circuit diagram illustrating a detailed configuration of the heater driving/heater temperature output circuit 301 according to the first embodiment.

Figure 5:
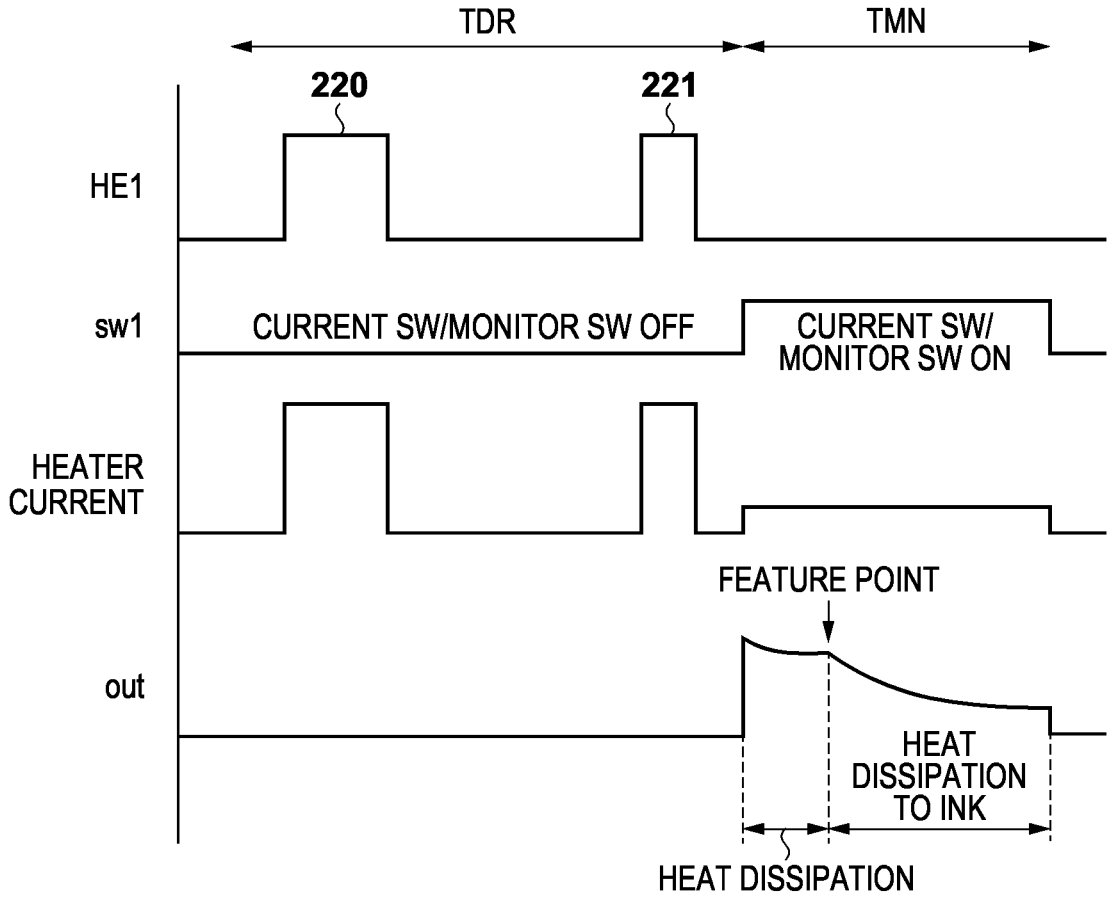
FIG. 5 is a timing chart for a signal according to a heater temperature detection of the heater driving/heater temperature output circuit illustrated in FIG. 4.

FIG. 5 is a timing chart for a signal according to a heater temperature detection of the heater driving/heater temperature output circuit 301 illustrated in FIG. 4.

According to FIG. 4, 256 drivers D1 to D256 for driving 256 heaters H1 to H256 are in an NDMOS source-follower configuration, and the heaters H1 to H256 are series-connected to the drivers D1 to D256. A power supply voltage supplied in a parallel connection to the 256 drivers D1 to D256 are of a voltage of about 24V to 34V, and the drivers D1 to D256 have a source-drain tolerable voltage that adequately satisfies this voltage. In the source-follower configuration, the source voltage (the voltage on the + side of the heaters H1 to H256) follows the gate voltage, and a voltage that is lower by $Vth+(2Id/\beta)^{1/2}$ than the gate voltage is outputted. Accordingly, even if the power source voltage VII which is the drain side of the drivers D1 to D256 changes in accordance with a voltage drop due to the electric current when driving the heaters H1 to H256, a constant voltage is applied to the heaters H1 to H256.

In a case where the heater H1 is driven, as is illustrated in FIG. 5, the heater current flows to the heater H1 in accordance with the time corresponding to the pulse width of the heater driving signal HE1 and the pulse voltage in the heater drive period TDR. Then, by the main pulse 220, the ink bubbles and is discharged from the nozzle. The change in temperature of the feature point is enhanced by thereafter applying a post pulse 221, of a level that does not cause bubbling, immediately prior to the feature point appearance upon bubble dissipation to thereby raise the heater temperature again.

Then, in a temperature monitor period TMN, a switch signal sw1 turns on, and for only a desired one segment (seg) (in this case, the heater H1), a current switch 105 and a monitor switch 106 turn on. At this time, the current for outputting the temperature voltage from a constant electric current source 107 flows to a heater H1 through the current switch 105. Simultaneously, through the monitor switch 106, the temperature voltage is inputted to a buffer amplifier 108, and an output signal out whose temperature voltage is amplified is outputted. Since the input of the buffer amplifier 108 is high impedance (HiZ), the current from the constant electric current source 107 is supplied to all of the heaters H1 to H256.

In this embodiment, the resistance values of the heaters H1 to H256 have a positive temperature characteristic, and by heating, the voltage of the output signal out rises, and then by heat dissipation, it drops. The power supply voltage VDD of the constant electric current source 107 and the buffer amplifier 108 is a voltage that is smaller than the power source voltage VH applied to drivers D1 to D256, and its voltage is about 3V to 5V. By the voltage being low, it becomes possible to downsize these circuits, and the result of this is that a reduction in manufacturing cost can be achieved. As described above, the reason that the circuits can be configured to enable low-voltage operation is that the drivers D1 to D256 are arranged between the power source voltage VII and the heaters H1 to H256, and a high voltage can be blocked in the temperature monitor period TMN. The constant electric current source 107 selects an appropriate current value so that a signal output in relation to the input/output range of the buffer amplifier 108 can be maximized, and outputs the current value.

Also, as is suggested by FIG. 4, the current switch 105 and the monitor switch 106 are formed by a high-voltage tolerance NMOS or NDMOS. In the heater drive period TDR, for the voltage on the + side of the heaters H1 to H256, a high voltage equivalent to the power source voltage VII is applied. Accordingly, similarly to the drivers D1 to D256, a transistor having a sufficient tolerable voltage to tolerate 24 to 34V which is the power source voltage VH is necessary.

Accordingly, similarly to the drivers D1 to D256, an NDMOS may be used. Thereby, it is possible to block the constant electric current source 107 and the buffer amplifier 108 configured by a low-voltage tolerant element from a high voltage in the heater drive period TDR. The gate voltage of the current switch 105 and the monitor switch 106 is controlled by the power supply voltage VDD, and when the switch signals sw1 to sw256 turn on, a voltage of about 3V to 5V is applied to the gate.

Furthermore, a node on the side of the heater of the current switch 105 and the monitor switch 106 is made to be the drain and the side of the constant current circuit 107 and the buffer amplifier 108 is made to be the source. By such a configuration, even if the switch signals sw1 to sw256 turn on due to a circuit malfunction in the heater drive period TDR, since it is a source-follower configuration, a voltage of greater than or equal to VDD which is the gate voltage will not be applied to the constant current circuit 107 and the buffer amplifier 108 side. Thereby, the circuit is protected from a high voltage. As described above, by configuring the current switch 105 and the monitor switch 106 with only an NMOS or a DMOS rather than a CMOS switch configuration, it is not only possible to downsize the circuit, but the safety of the circuit is also caused to improve.

Accordingly, in accordance with the embodiment described above, by configuring temperature detection circuit that detects a temperature of a heater with a low power supply voltage and at a high sensitivity without adding a temperature sensor, it is possible to achieve both cost reduction of the head substrate and high-accuracy discharging detection.

Note that in the above-described embodiment, the drivers D1 to D256 were of an NDMOS source-follower configuration, but may be configured with a PDMOS. In such a case, the PDMOS is of a source-ground configuration, and therefore its function for uniform control of the voltage of the heaters H1 to H256 as described previously is lost, and it functions as a switch. Also, the heater driving signals HE1 to HE256 are inverted signals (drive on Low). However, even if the configuration of the drivers D1 to D256 is changed, in a state in which the circuit, which is for detecting the heater temperature and outputting it, is blocked from a high voltage, no inconvenience arises as long as the purpose of monitoring the temperature of the heaters H1 to H256 is fulfilled.

Second Embodiment

An example of a heater temperature detection, that is different from the first embodiment, that uses the heater driving/heater temperature output circuit 301 illustrated in the first embodiment will be described.

Figure 6:
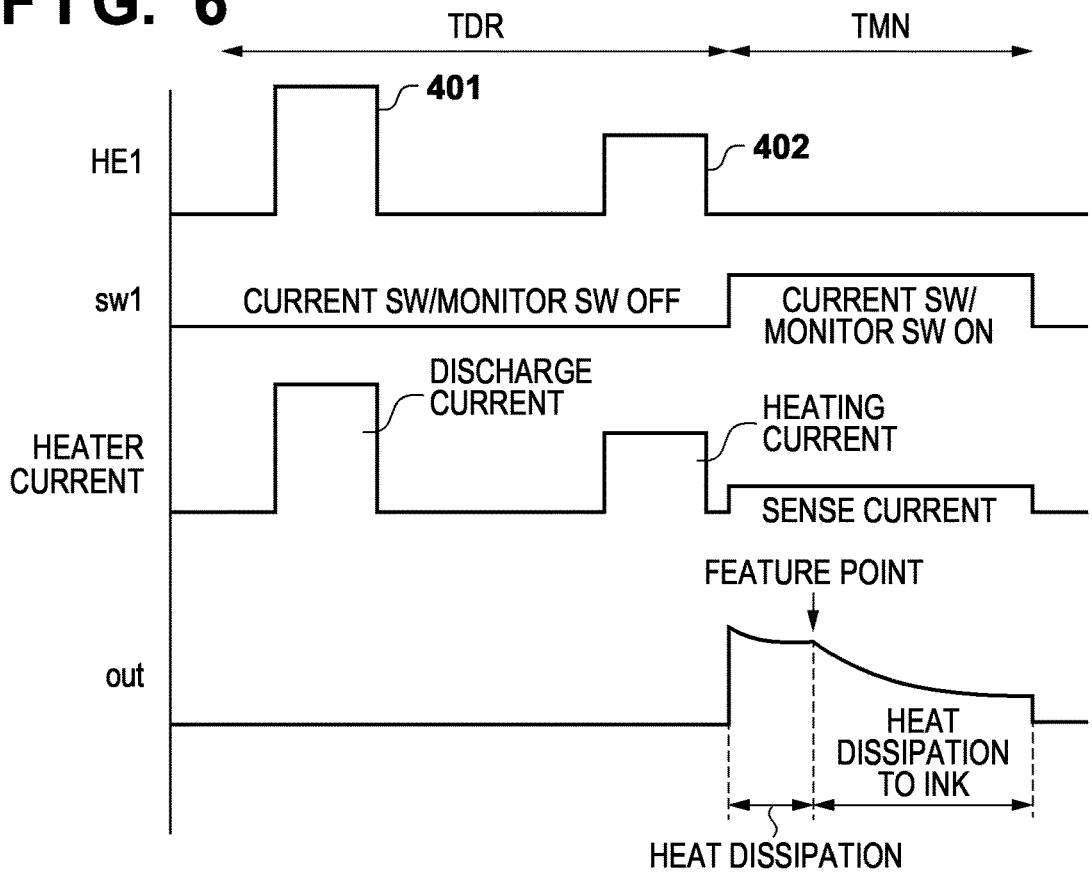
FIG. 6 is a timing chart for a signal of a heater temperature detection of the heater driving/heater temperature output circuit according to the second embodiment.
Figure 7:
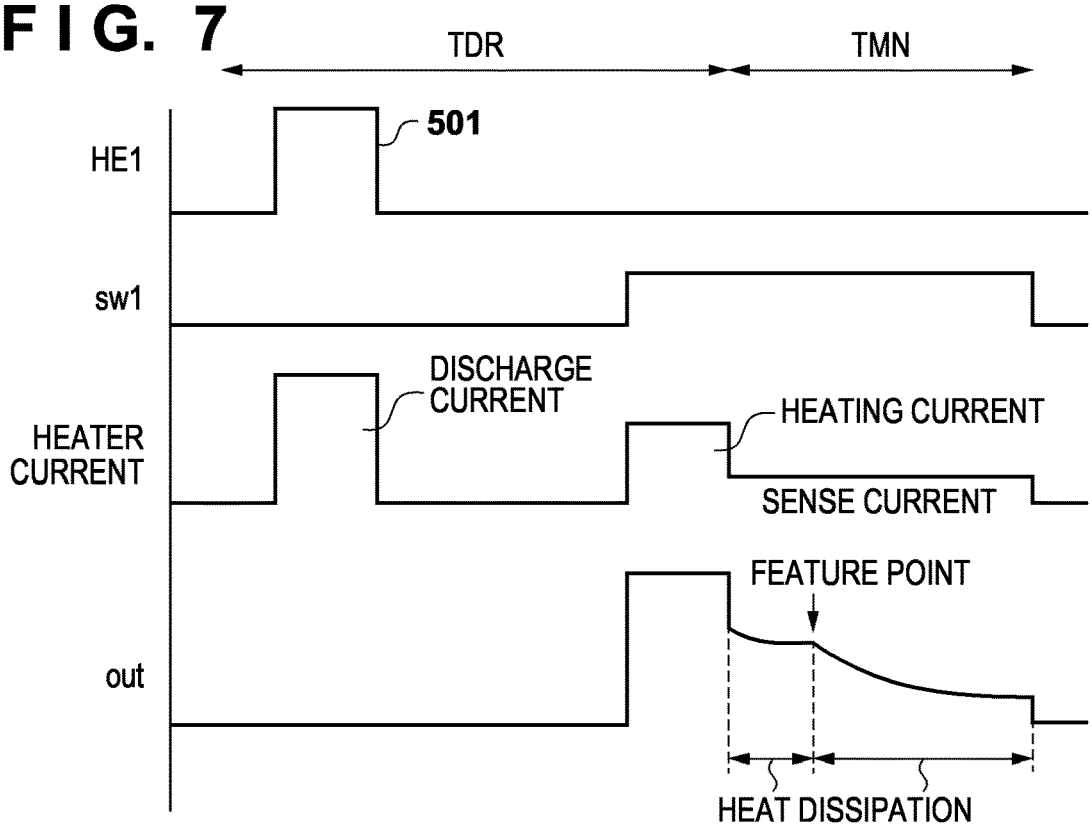
FIG. 7 is a timing chart for a signal of a heater temperature detection of the heater driving/heater temperature output circuit according to the second embodiment.

FIG. 6 and FIG. 7 are timing charts for signals according to the heater temperature detection by the heater driving/heater temperature output circuit 301, according to the second embodiment. Note that in FIG. 6 and FIG. 7, the description regarding details of these signals is omitted since the same signals as those mentioned in FIG. 5 are used.

According to FIG. 5, in the first embodiment, the wave height values (current values) of the heater currents that flow in the main pulse 220 and the post pulse 221 are the same, and the pulse width of the post pulse 221 is shorter than the pulse width of the main pulse 220. In contrast to this, here, as illustrated in FIG. 6, the current values of a main pulse 401 and a post pulse 402 are different, and the current value in the post pulse 402 is smaller than the current value of the post pulse 221 described in the first embodiment (FIG. 5) and of a relatively longer pulse width. In the first place, a high heat flux is necessary since ink film boiling is the purpose of the main pulse, but since ink heating is the purpose of the post pulse, a long, slow heating is more suitable than a dramatic heating since it is possible to transfer heat broadly and evenly to the heater. Thereby, it becomes possible to make the temperature change of the heater at the feature point steeper. Such driving is enabled by giving the drivers D1 to D256 an NDMOS source-follower configuration, and controlling the voltage amplitude applied to the gate as with the heater driving signal HE1 illustrated in FIG. 6.

Also, the example of driving illustrated in FIG. 5 and FIG. 6 is an example of applying a post pulse by the heater driving signal HE1, and since a long and slow heating of the heater is more suitable, the post pulse may be applied from the constant electric current source 107.

FIG. 7 is a view illustrating an example of applying the post pulse by the constant electric current source 107.

According to FIG. 7, the main pulse 501 is applied by the heater driving signal HE1, ink is discharged, and the heater D1 is heated by supplying a larger current from the constant electric current source 107 prior to the feature point appearance. Then, immediately prior to the feature point appearance, the current supply is caused to decrease, and the temperature voltage is outputted.

Here, compared with the drive examples of FIG. 6 and FIG. 7, in the configuration of FIG. 6, there is the drawback that the driver D1 generates heat in proportion to the reduction of the generated heat of the heater H1 by the post pulse 402, but a higher heat can be applied to the heater H1 than with the configuration of FIG. 7. In the configuration of FIG. 7, the power consumption is smaller and the amount of heating is smaller than in the drive example illustrated in FIG. 6, but responsiveness is good since it is a configuration that drives the circuit at a low power supply voltage, and it is possible to heat the heater to just before the appearance of the feature point as illustrated in FIG. 7.

Accordingly, in accordance with the embodiment described above, compared to the first embodiment, by changing the method of driving the post pulse, the heating of the heater is performed more appropriately, and responsiveness is improved, and it becomes possible to raise the accuracy of the discharge detection.

Third Embodiment

Figure 8:
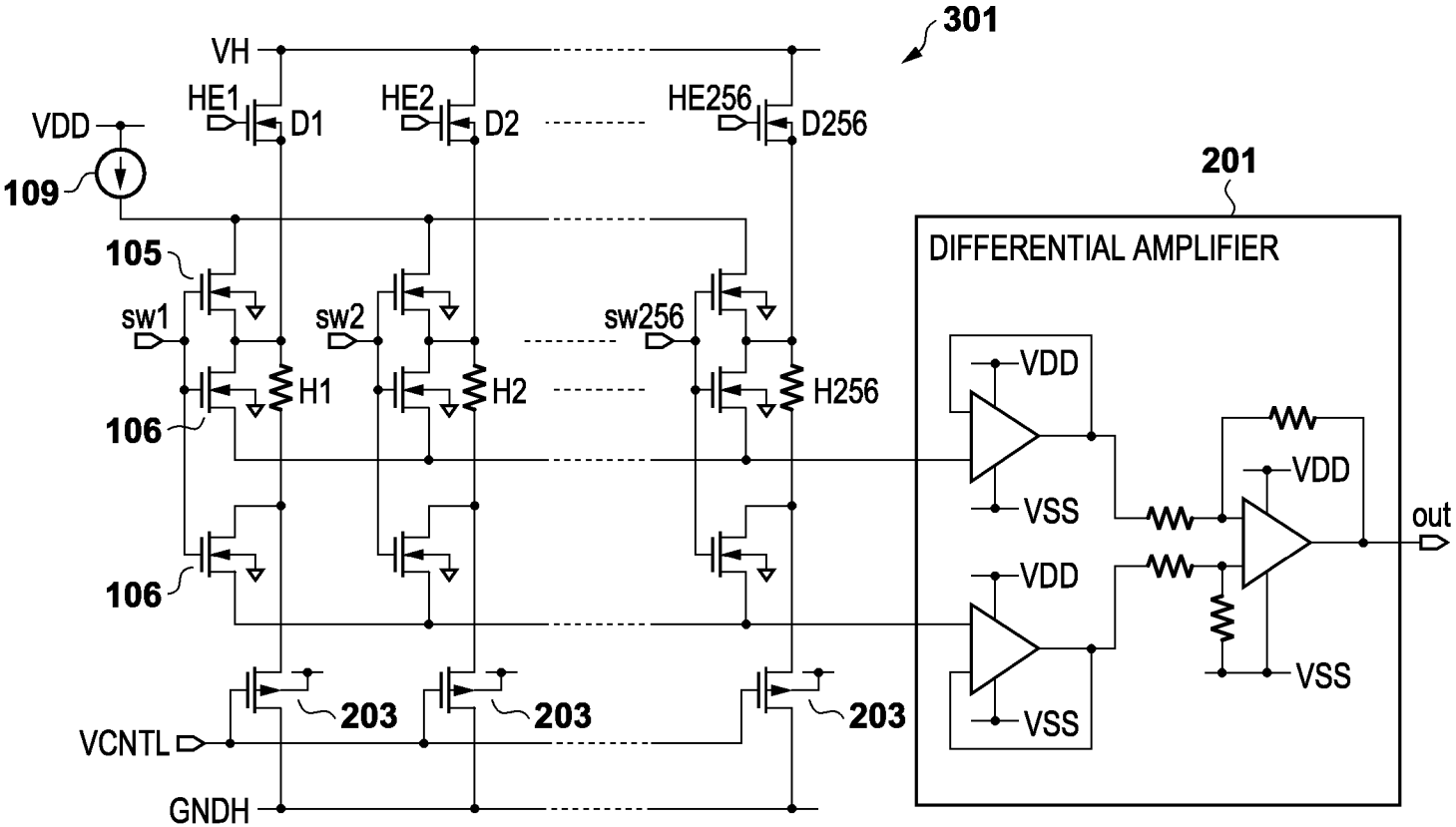
FIG. 8 is an equivalent circuit diagram illustrating a detailed configuration of a heater driving/heater temperature output circuit according to the third embodiment.

FIG. 8 is an equivalent circuit diagram that illustrates a detailed configuration of the heater driving/heater temperature output circuit 301 according to the third embodiment. Note that in FIG. 8, the same reference numerals and reference symbols are added to components and signals that are the same as those already described with reference to FIG. 4, and description thereof will be omitted.

As can be seen by comparing FIG. 8 and FIG. 4, in the example illustrated in FIG. 4, the source-follower configuration drivers D1 to D256 are arranged on the power source voltage VH side, but in the exampled illustrated in FIG. 8, PMOSs 203 of a source-follower configuration are arranged on the ground voltage GNDH side. Also, the control voltage VCNTL is applied to the gate of the PMOSs, and the drain voltage is controlled to a voltage where $(2Id/\beta)^{1/2}$ is added onto the control voltage VCNTL at the time of driving the heater. Accordingly, in the configuration illustrated in FIG. 8, even if both the ground voltage GNDH and the power source voltage VH change, the voltages on both sides of the heaters H1 to H256 are kept fixed. Accordingly, it is possible to make the heater voltage uniform with respect to voltage fluctuations due to heater driving, and since a pulse-width modulation of the heater driving signals HE1 to HE256 is unnecessary, more stable ink discharge becomes possible. Also, since a high voltage is never applied to the PMOSs 203, it is possible to have a PMOS configuration which is a low-voltage tolerant element, but configuration with a PDMOS which is a high-voltage tolerant element is also possible.

Note that in regards to the discharge detection operation, even in the circuit configuration illustrated in FIG. 8, similar drive control to what was described using FIG. 5 to FIG. 7 in the first and second embodiments is possible. However, in the temperature monitor period TMN, when a constant electric current is made to flow, the voltage on the ground voltage GNDH side of the heaters H1 to H256 rises due to a source-follower operation of the PMOS 203, and the range of heater voltage becomes narrower compared to the configuration of FIG. 4. Accordingly, in FIG. 8, by making a part configured by the simple buffer amplifier 108 in FIG. 4 be a configuration of a differential amplifier 201, a difference of the voltages on both sides of the heaters H1 to H256 is taken, and the signal output range is maximized by signal amplification proportional to how much the range narrows.

Accordingly, in accordance with the embodiment described above, even in a case where both sides of the heaters are made to be of a source-follower configuration, it is possible to achieve a similar effect to the first and second embodiments. Also, there is the advantage that the voltages on both sides of the heaters H1 to H256 are kept fixed by the configuration of this embodiment.

Fourth Embodiment

Figure 9:
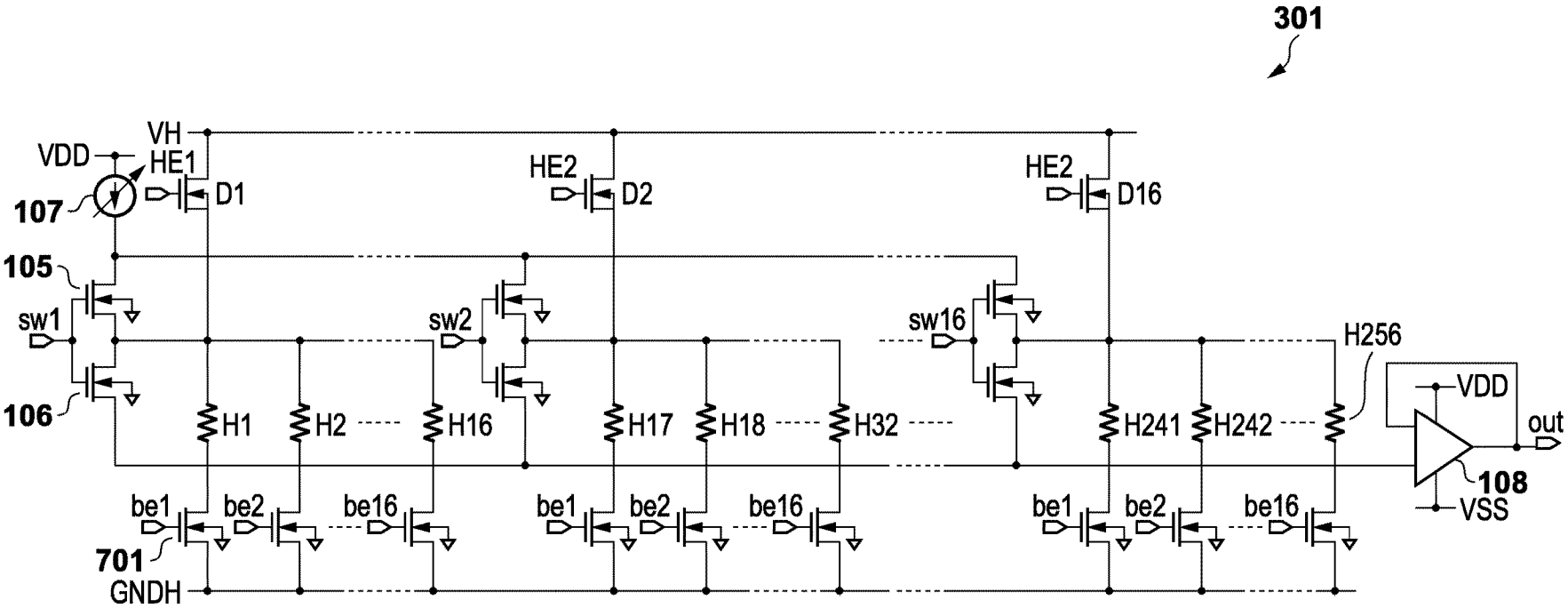
FIG. 9 is an equivalent circuit diagram illustrating a detailed configuration of a heater driving/heater temperature output circuit according to the fourth embodiment.

FIG. 9 is an equivalent circuit diagram that illustrates a detailed configuration of the heater driving/heater temperature output circuit 301 according to the fourth embodiment. Note that, in FIG. 9, the same reference numbers and reference symbols are added to components and signals that are the same as those described already with reference to FIG. 4, and description thereof is omitted.

As can be seen by comparing FIG. 9 and FIG. 4, in this embodiment, one source-follower driver is configured to be connected in relation to 16 seg, in other words 16 heaters. Accordingly, 16 drivers D1 to D16 are connected in relation to 256 seg, in other words 256 heaters H1 to H256, and configuration is such that these heaters are driven time-divisionally. With such a circuit configuration, by sharing a source-follower configuration of a large layout surface area with a plurality of heaters (16 in this embodiment), it is possible to achieve a circuit for performing control to make the heater voltage uniform in a comparatively small layout surface area. Also, on the ground voltage GNDH side of the 256 heaters H1 to H256, a source-ground block selection driver 701 is connected to each heater. The block selection drivers 701 are sequentially turned on in each block drive period in accordance with time-division driving. Accordingly, the configuration is such that 16 block selection signals be1 to be16 are inputted to a 16 block selection driver (block selection circuit).

Note that among the 256 heaters H1 to H256, one group of heaters is configured to be16 heaters arranged to be close to each other, and a total of 16 groups are formed. Also, one heater is selected time-divisionally from each group, and a block consisting of a total of 16 heaters is formed, and a maximum of 16 heaters belonging to each block are driven time-divisionally. For such a configuration, it is sufficient to have 16 drivers H1 to 1116, as illustrated in FIG. 9.

In such a configuration, since it is sufficient to arrange the current switch 105 and the monitor switch 106 for each 16 seg (in other words, each 16 heaters), compared to the configuration in FIG. 4, it is possible to achieve discharge detection in a smaller layout surface area. Additionally, a cost reduction in the head substrate is achieved. Furthermore, the number of monitor switches 106 parallel-connected to one buffer amplifier 108 is small at 16, and so the influence of parasitic capacitance is small, and compared to the configuration of FIG. 4, it is possible to achieve a temperature voltage waveform whose frequency characteristic is good and with better sensitivity.

Meanwhile, to arrange the block selection driver 701, the voltage for this driver is superimposed on the temperature voltage waveform, and the signal voltage range ends up being regulated. However, the block selection driver is source-grounded, and compared to a heater resistor, its resistance is low, and so the influence thereof is not large. Also, in the case where a temperature signal is desired to be retrieved at a higher accuracy, a configuration of a buffer amplifier may be configured as with a differential amplifier 201, as illustrated in FIG. 8.

Accordingly, in accordance with the embodiment described above, it is possible to realize discharge detection as illustrated in the first and second embodiments, and it is possible to further reduce the surface area of the head substrate, and therefore it is possible to contribute to further cost reduction.

Fifth Embodiment

Figure 10:
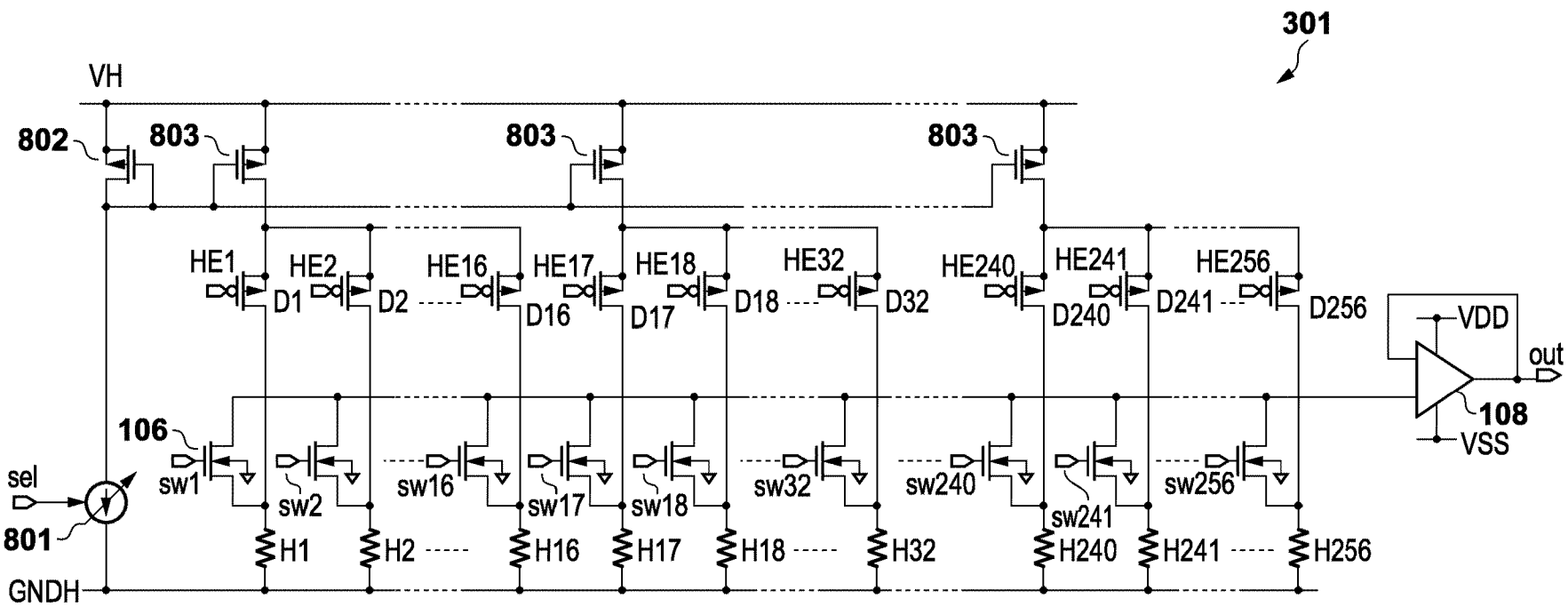
FIG. 10 is an equivalent circuit diagram illustrating a detailed configuration of a heater driving/heater temperature output circuit according to the fifth embodiment.
Figure 11A:
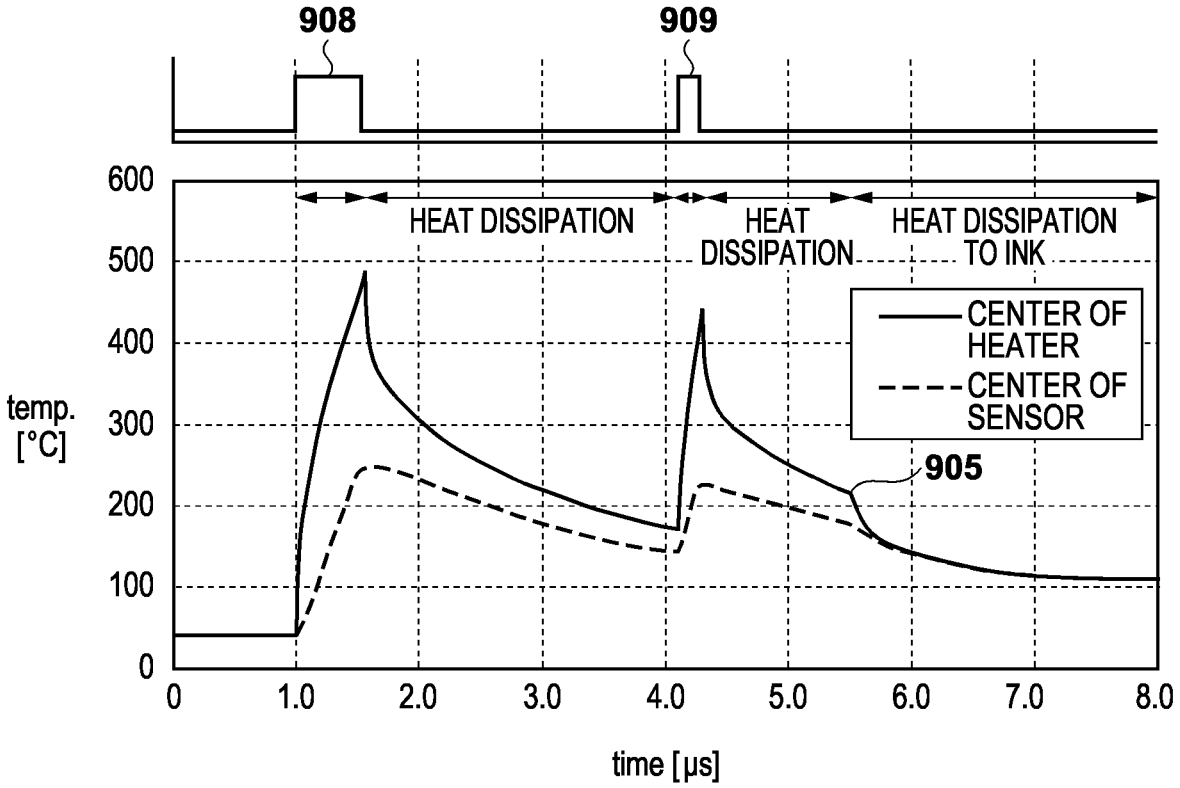
FIGS. 11A and 11B are views for illustrating a cross section of a heater unit integrated in the head substrate proposed in Japanese Patent No. 5801612 and the results of simulating a change in temperature of a heater.
Figure 11B:
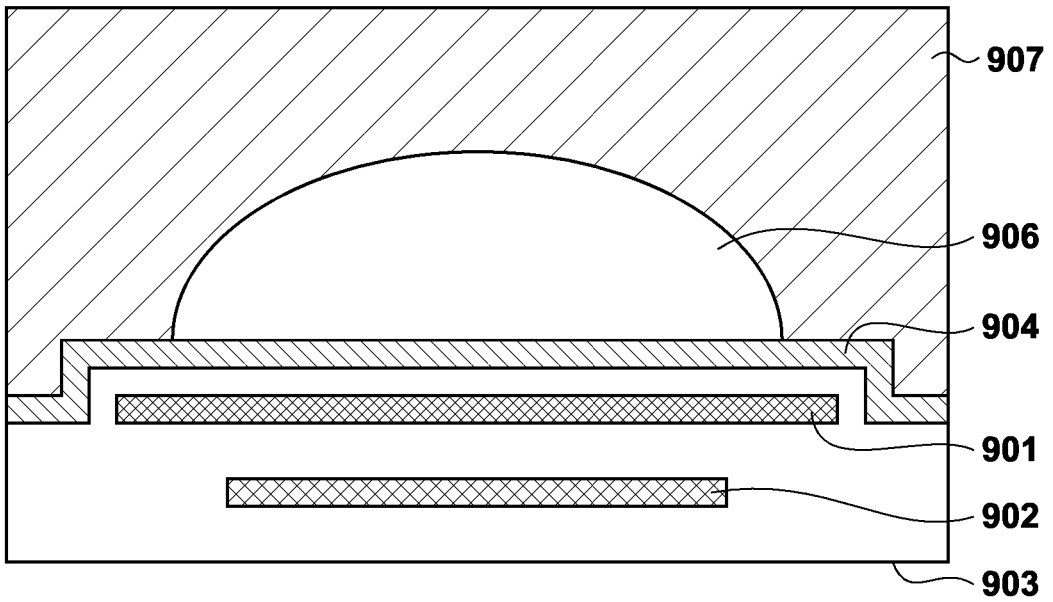

FIG. 10 is an equivalent circuit diagram that illustrates a detailed configuration of the heater driving/heater temperature output circuit 301 according to the fifth embodiment. Note that in FIG. 10, the same reference numeral and reference symbols are added to components and signals that are the same as those already described with reference to FIG. 4, and description thereof will be omitted.

The circuit configurations of the above-described embodiments are all configurations in which the heaters are voltage-driven in order to discharge ink and the heaters are current-driven in order to detect discharge, but here all are configured to be constant-current-driven.

According to the configuration illustrated in FIG. 10, an electric current supplied to the heaters H1 to H256 is decided by a variable constant electric current source 801. The current here flows to a mirror source PMOS 802, and is mirrored in mirrored PMOSs 803, and PMOS drivers D1 to D256 are turned on by a pulse width in accordance with the heater driving signals HE1 to HE256, and a desired constant electric current is supplied to the heaters H1 to H256. Here, a single-stage configuration current mirror circuit configured by the PMOS 802 and the PMOS 803 is given as an example, but a current mirror circuit of a cascade-configuration may also be employed.

When the circuit configuration illustrated in FIG. 10 is employed, regarding heater driving for ink discharge, regardless of whether there is a voltage fluctuation of the power source voltage VH and the ground voltage GNDH, driving at a constant current is always possible. Thereby, pulse-width modulation (PWM) control of the heater driving signals HE1 to HE256 becomes unnecessary, and therefore more stable ink discharge becomes possible.

Furthermore, compared to configurations of other embodiments related to a discharge detection operation, not only the constant electric current source 107 for temperature detection but also the current switch 105 are eliminated, and therefore it is possible to further reduce the manufacturing cost of the head substrate. Also, since the current to be supplied to the heaters H1 to H256 is variable in the constant electric current source 801, it is possible to easily achieve the heater driving control described with reference to FIG. 5 to FIG. 7. Also, as illustrated in FIG. 8 and FIG. 9, since there is no element on the ground voltage GNDH side of the heaters H1 to H256, it is possible to achieve a broad voltage range similarly to the circuit configuration illustrated in FIG. 4, and so more highly accurate discharge detection.

In the embodiment described above, the judgment circuit for judging discharge/non-discharge is arranged on the substrate, but configuration may be such that the judgment circuit is arranged in the main body portion of the printing apparatus, and the output of the heater temperature output circuit is outputted as is to the main body portion.

Note that in the above-described embodiments, the printhead that discharges ink and the printing apparatus have been described as an example. However, the present invention is not limited to this. The present invention can be applied to an apparatus such as a printer, a copying machine, a facsimile including a communication system, or a word processor including a printer unit, and an industrial printing apparatus complexly combined with various kinds of processing apparatuses. In addition, the present invention can also be used for the purpose of, for example, biochip manufacture, electronic circuit printing, color filter manufacture, or the like.

The printhead described in the above embodiments can also be considered as a liquid discharge head in general. The substance discharged from the head is not limited to ink, and can be considered as a liquid in general.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-228613, filed Dec. 18, 2019, which is hereby incorporated by reference herein in its entirety.

What is claimed is:

1. An element substrate comprising:

a plurality of nozzles configured to discharge a liquid;

a plurality of electrothermal transducers corresponding to the plurality of nozzles;

a plurality of drivers corresponding to the plurality of electrothermal transducers; and a detection circuit configured to detect a temperature of each electrothermal transducer, wherein after a first signal is applied to a selected electrothermal transducer in the plurality of electrothermal transducers in order to discharge a liquid from a nozzle corresponding to the selected electrothermal transducer, a second signal is applied to the selected electrothermal transducer in order to detect a temperature of the selected electrothermal transducer by the detection circuit.

2. The element substrate according to claim 1, further comprising a judgment circuit configured to judge whether liquid is discharged from the nozzle corresponding to the selected electrothermal transducer based on a feature point that appears in a change over time of the temperature of the electrothermal transducer detected by the detection circuit.

3. The element substrate according to claim 2, further comprising a first constant electric current source configured to supply a constant electric current to drive the detection circuit, wherein a first power supply voltage applied to the plurality of drivers is higher than a second power supply voltage applied to drive the first constant electric current source.

4. The element substrate according to claim 3, wherein the plurality of electrothermal transducers are connected to the plurality of drivers respectively, and the plurality of drivers are connected to a side of the first power supply voltage, and the plurality of electrothermal transducers are connected to a side of a ground voltage.

5. The element substrate according to claim 4, wherein the detection circuit is provided to each of the plurality of electrothermal transducers.

6. The element substrate according to claim 5, further comprising:

a PMOS provided in a source-follower configuration between the plurality of respective electrothermal transducers and the ground voltage; and a differential amplifier configured to amplify a signal indicating the temperature of the electrothermal transducer detected by the detection circuit.

7. The element substrate according to claim 5, wherein the detection circuit includes:

a first circuit configured to select an electrothermal transducer for detecting a temperature by the inputted signal; and a second circuit configured to monitor the temperature of the electrothermal transducer selected by the first circuit.

8. The element substrate according to claim 3, further comprising a block selection circuit configured to divide the plurality of electrothermal transducers into a plurality of blocks, and select one of the plurality of blocks for time-divisional drive, wherein a number of the plurality of drivers is the same as a number of a plurality of groups formed from a plurality of electrothermal transducers, among the plurality of the electrothermal transducers, that are arranged to be close to each other, each of the plurality of drivers connects with an electrothermal transducer belonging to a respective one of the plurality of groups, and one of the detection circuit is provided to each of the plurality of groups, and the block selection circuit selects the plurality of electrothermal transducers belonging to the plurality of groups, respectively, in time-divisional order.

9. The element substrate according to claim 8, wherein the detection circuit includes:

a first circuit configured to select an electrothermal transducer for detecting a temperature by the inputted signal; and a second circuit configured to monitor the temperature of the electrothermal transducer selected by the first circuit.

10. The element substrate according to claim 2, further comprising:

a second constant electric current source; and a current mirror circuit configured to constant-current-drive the plurality of drivers based on a constant electric current supplied from the second constant electric current source.

11. The element substrate according to claim 10, wherein the detection circuit includes a circuit configured to select an electrothermal transducer for detecting temperature by the inputted signal.

12. A liquid discharge head using an element substrate, wherein the element substrate comprises: a plurality of nozzles configured to discharge a liquid; a plurality of electrothermal transducers corresponding to the plurality of nozzles; a plurality of drivers corresponding to the plurality of electrothermal transducers; and a detection circuit configured to detect a temperature of each electrothermal transducer, and, after a first signal is applied to a selected electrothermal transducer in the plurality of electrothermal transducers in order to discharge a liquid from a nozzle corresponding to the selected electrothermal transducer, a second signal is applied to the selected electrothermal transducer in order to detect a temperature of the selected electrothermal transducer by the detection circuit, the liquid discharge head comprising:

a judgment circuit configured to judge whether liquid is discharged from the nozzle corresponding to the selected electrothermal transducer based on a feature point that appears in a change over time of the temperature of the electrothermal transducer detected by the detection circuit; and a first constant electric current source configured to supply a constant electric current to drive the detection circuit, wherein a first power supply voltage applied to the plurality of drivers is higher than a second power supply voltage applied to drive the first constant electric current source.

13. A printing apparatus for performing printing on a print medium comprising:

a printhead configured to use a liquid discharge head for discharging a liquid and discharge ink as the liquid, wherein the liquid discharge head uses an element substrate, and the element substrate comprises:

a plurality of nozzles configured to discharge a liquid;

a plurality of electrothermal transducers corresponding to the plurality of nozzles;

a plurality of drivers corresponding to the plurality of electrothermal transducers; and a detection circuit configured to detect a temperature of each electrothermal transducer, and after a first signal is applied to a selected electrothermal transducer in the plurality of electrothermal transducers in order to discharge a liquid from a nozzle corresponding to the selected electrothermal transducer, a second signal is applied to the selected electrothermal transducer in order to detect a temperature of the selected electrothermal transducer by the detection circuit, and the liquid discharge head comprises:

a judgment circuit configured to judge whether liquid is discharged from the nozzle corresponding to the selected electrothermal transducer based on a feature point that appears in a change over time of the temperature of the electrothermal transducer detected by the detection circuit; and a first constant electric current source configured to supply a constant electric current to drive the detection circuit, wherein a first power supply voltage applied to the plurality of drivers is higher than a second power supply voltage applied to drive the first constant electric current source;

a first generation unit configured to generate the first signal and output the first signal to the printhead to drive the plurality of drivers in order to discharge ink from nozzles corresponding to the plurality of drivers;

a second generation unit configured to generate a signal for selecting an electrothermal transducer for the detection circuit to detect the temperature, and to output the signal to the printhead; and a control unit configured to control printing by the printhead based on a result of the judgement by the judgment circuit.

14. The apparatus according to claim 13, wherein the first generation unit generates the second signal in order to heat the selected electrothermal transducer before the feature point appears in a temperature decrease process of the selected electrothermal transducer, subsequent to the first signal.

15. The apparatus according to claim 14, wherein current values of the first signal and the second signal are the same, and a pulse width of the second signal is shorter than a pulse width of the first signal.

16. The apparatus according to claim 14, wherein a current value of the second signal is smaller than a current value of the first signal, and a pulse width of the second signal is relatively longer than a pulse width of the first signal.

* * * * *